US009228393B2

(12) United States Patent
Logan et al.

(10) Patent No.: US 9,228,393 B2
(45) Date of Patent: Jan. 5, 2016

(54) METHOD AND SYSTEM OF DRILLING LATERALS IN SHALE FORMATIONS

(75) Inventors: Richard B. Logan, Houston, TX (US); Stephen R. Ingram, Houston, TX (US); Martin D. Paulk, Houston, TX (US); Hamayun Z. Raja, Houston, TX (US)

(73) Assignee: Landmark Graphics Corporation, Houston, TX (US)

( * ) Notice: Subject to any disclaimer, the term of this patent is extended or adjusted under 35 U.S.C. 154(b) by 317 days.

(21) Appl. No.: 13/995,537

(22) PCT Filed: Mar. 8, 2011

(86) PCT No.: PCT/US2011/027484

§ 371 (c)(1), (2), (4) Date: Jun. 19, 2013

(87) PCT Pub. No.: WO2012/121707

PCT Pub. Date: Sep. 13, 2012

(65) Prior Publication Data

US 2013/0270009 A1 Oct. 17, 2013

(51) Int. Cl.

| | |
|---|---|
| ***E21B 7/04*** | (2006.01) |
| ***E21B 7/10*** | (2006.01) |
| ***E21B 47/022*** | (2012.01) |

(52) U.S. Cl.

CPC . *E21B 7/046* (2013.01); *E21B 7/04* (2013.01); *E21B 7/10* (2013.01); *E21B 47/02208* (2013.01)

(58) Field of Classification Search

CPC ..... E21B 7/046; E21B 7/04; E21B 7/10; E21B 3/00; E21B 47/02208

See application file for complete search history.

(56) References Cited

U.S. PATENT DOCUMENTS

| | | | |
|---|---|---|---|
| 4,905,774 | A | 3/1990 | Wittrisch |
| 5,064,006 | A | 11/1991 | Waters et al. |
| 5,241,273 | A | 8/1993 | Luling |
| 5,242,025 | A | 9/1993 | Neill et al. |
| 5,540,101 | A | 7/1996 | Capelle et al. |
| 6,084,826 | A | 7/2000 | Leggett, III |
| 7,063,174 | B2 | 6/2006 | Chemali et al. |
| 7,181,380 | B2 | 2/2007 | Dusterhoft et al. |
| 7,657,407 | B2 | 2/2010 | Logan |
| 2004/0245016 | A1 * | 12/2004 | Chemali et al. ..... 175/25 |
| 2006/0157277 | A1 | 7/2006 | Bittar et al. |

FOREIGN PATENT DOCUMENTS

WO WO 2009/021010 A2 2/2009

OTHER PUBLICATIONS

International Search Report and Written Opinion issued Oct. 20, 2011 in International Application No. PCT/US2011/027484 filed Mar. 8, 2011.

(Continued)

*Primary Examiner* — Yong-Suk (Philip) Ro

(57) ABSTRACT

Drilling laterals in shale formations. At least some of the illustrative embodiments are methods including: drilling a deviated borehole through a shale formation with a drill string comprising a drill bit; logging the shale formation with a logging tool disposed within the drill string; estimating, in real time with the drilling, fracture potential of a portion of the shale formation near the drill bit, the estimation of fracture potential based on information acquired by the logging tool; and controlling drilling direction based on the fracture potential.

20 Claims, 5 Drawing Sheets

(56) References Cited

OTHER PUBLICATIONS

Buller, D. et al. Petrophysical Evaluation for Enhancing Hydraulic Stimulation in Horizontal Shale Gas Wells. SPE 132990. Society of Petroleum Engineers. SPE Annual Technical Conference and Exhibition; Florence, Italy; Sep. 19-22, 2010.
Market, J. et al. Logging-While-Drilling in Unconventional Shales. SPE 133684. Society of Petroleum Engineers. SPE Annual Technical Conference and Exhibition; Florence, Italy; Sep. 19-22, 2010.
Market, J. et al. Wellbore Profiling with Broadband Multipole Sonic Tools. SPE 123865. Society of Petroleum Engineers. SPE Annual Technical Conference and Exhibition; New Orleans, Louisiana; Oct. 4-7, 2009.
Weatherford. Compact Cross-Dipole Sonic (CXD). Weatherford. 2010.
Halliburton-Sperry Drilling. Sperry Drilling MWD/LWD Services. Halliburton. 2010.
Kundert, D. et al. Proper Evaluation of Shale Gas Reservoirs Leads to a More Effective Hydraulic-Fracture Stimulation. SPE 123586. Society of Petroleum Engineers. SPE Rocky Mountain Petroleum Technology Conference; Denver, Colorado; Apr. 14-16, 2009.
Garcia, M. et al. Calibrated Log Model and Reservoir Understanding Allows Accurate Prediction of Production and Improved Hydraulic-Fracturing Designs. SPE 123354. Society of Petroleum Engineers. SPE Rocky Mountain Petroleum Technology Conference; Denver, Colorado; Apr. 14-16, 2009.
Parker, M. et al. Haynesville Shale-Petrophysical Evaluation. SPE 122937. Society of Petroleum Engineers. SPE Rocky Mountain Petroleum Technology Conference; Denver, Colorado; Apr. 14-16, 2009.
Mille, B. et al. The Successful Application of a Compartmental Completion Technique Used to Isolate Multiple Hydraulic-Fracture Treatments in Horizontal Bakken Shale Wells in North Dakota. SPE 116469. Society of Petroleum Engineers. SPE Annual Technical Conference and Exhibition; Denver, Colorado; Sep. 21-24, 2008.
Rickman, R. et al. A Practical Use of Shale Petrophysics for Stimulation Design Optimization: All Shale Plays are Not Clones of the Barnett Shale. SPE 115258. Society of Petroleum Engineers. SPE Annual Technical Conference and Exhibition; Denver, Colorado; Sep. 21-24, 2008.
Mullen, M. et al. A Composite Determination of Mechanical Rock Properties for Stimulation Design (What to Do When You Don't Have a Sonic Log). SPE 108139. Society of Petroleum Engineers. SPE Rocky Mountain Oil & Gas Technology Symposium; Denver, Colorado; Apr. 16-18, 2007.
Chinese Office Action (and English Translation), Patent Application No. 201180069152.1, Dec. 2, 2014, 13 pages.
Canadian Office Action, May 26, 2015, Canadian Patent Application No. 2,828,717, 4 pages.
Australian Office Action, Apr. 23, 2015, Australian Patent Application No. 2011361739, 6 pages.

* cited by examiner

METHOD AND SYSTEM OF DRILLING LATERALS IN SHALE FORMATIONS

CROSS-REFERENCE TO RELATED APPLICATIONS

None.

BACKGROUND

Advances in horizontal drilling and hydraulic fracturing technology have lead to the ability to economically recover hydrocarbons (mostly natural gas) from shale formations. However, placement of the horizontal borehole (also known as a lateral) requires particular accuracy. For example, a shale formation may be several thousand feet below the surface, and the shale formation itself may be on the order of 1000 feet thick. Within the illustrative 1000 feet of thickness only a few relatively thin zones, each zone on the order of tens of feet thick, may be suitable locations for placement of the lateral and extraction of hydrocarbons (i.e., target zones). Outside the target zones, some hydrocarbon extraction may be possible, but such extraction is in most cases not economically viable.

Moreover, physical phenomena such as faulting and differential compaction may make the true vertical depth of the target zones different as a function of horizontal location within the shale formation. Even if one is able to identify at a particular location a target zone for lateral placement (e.g., at a vertical survey borehole), the precise depth of the target zone may change as a function of distance from the particular location.

Thus, any advance which results in better identification of target zones, and more consistent placement of laterals within the target zones, would provide a competitive advantage.

BRIEF DESCRIPTION OF THE DRAWINGS

For a detailed description of exemplary embodiments, reference will now be made to the accompanying drawings in which.

NOTATION AND NOMENCLATURE

Figure 1:
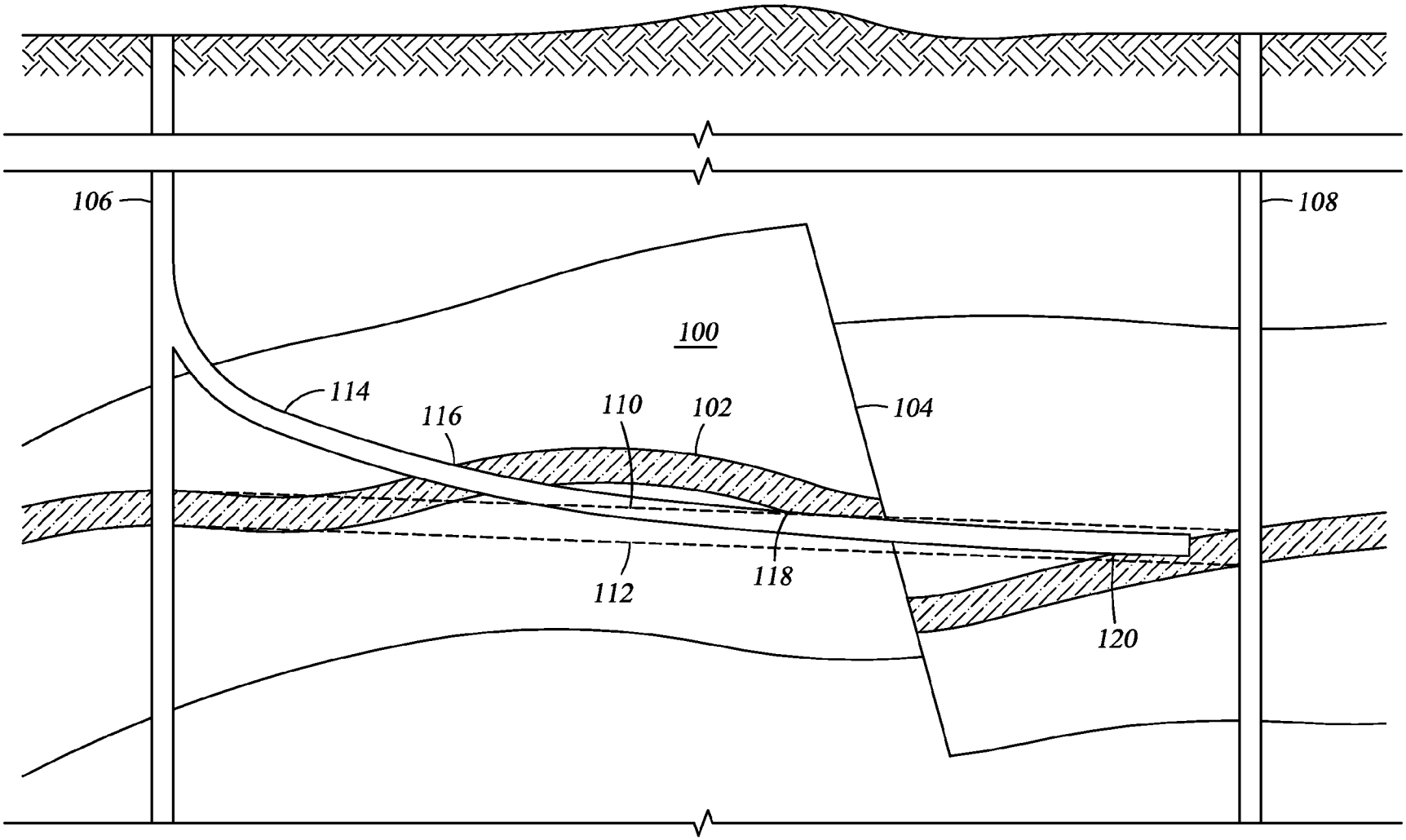
FIG. 1 shows a cross-sectional view of a shale formation to explain how laterals are placed prior the various embodiments described herein.

Certain terms are used throughout the following description and claims to refer to particular system components. As one skilled in the art will appreciate, oilfield service companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection or through an indirect electrical connection.

"Real time" shall mean completing a task with respect to a borehole while the borehole is being drilling and before the borehole length increases 50 feet.

"Near" in relation to a drill bit shall mean within 100 feet of the drill bit.

"Deviated borehole" shall mean a borehole that deviates by twenty (20) degrees or greater from vertical.

"Mechanical property" shall mean a predicted response of material to applied mechanical forces (e.g., stress or strain), and shall not refer to an electrical property (i.e., resistivity, dielectric strength), physical property (e.g., porosity, permeability), or an indication of saturation of the material with hydrocarbons.

"Fracture potential" shall mean a value, or set of values, indicative of the susceptibility of a portion of a formation to fracture along a first direction and susceptibility of the portion of the formation to fracture along a second direction, where the second direction is perpendicular to the first direction. Fracturing potential may be alternatively referred to as "fracture index".

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

The various embodiments of the invention are directed to systems and related methods of performing real time formation evaluation of shale formations while drilling deviated boreholes into the shale formations (particularly laterals into target zones), and controlling drilling direction based on mechanical properties of the shale formation determined in the real time formation evaluation. Before getting into the specifics, it is helpful to an understanding of the benefits of the various embodiments to discuss how formation evaluation and lateral placement is performed in the related-art.

Underground shale formations may reside several thousand feet below the surface, and may be on the order of 1000 feet thick. While an entire formation may be saturated to some extent with hydrocarbons, hydrocarbons may be economically produced from only relatively small zones within the shale formation, with the relatively small zones on the order of tens of feet thick but having relatively large horizontal extent. The relatively small zones from which hydrocarbons can be economically produced are referred to herein as target zones. FIG. 1 shows a cross-sectional view of an illustrative underground shale formation 100 having a single target zone 102 (shown in cross-hatch). Though the materials that make up shale formations may initially be deposited in horizontal layers, differential compaction and faulting may result in present day true vertical depth of both the shale formation 100, and the target zone 102, being different as function of horizontal location, and FIG. 1 illustrates such differences. For example, the shale formation 100, possibly as a function of differential compaction, has an undulating form. Moreover, the illustrative shale formation 100 has a fault 104 which resulted in a vertical shift of otherwise related portions of the shale formation 104.

In the related-art, the target zones are usually identified by drilling one or more vertical boreholes through the shale formation (that is, vertical or substantially vertical through the entire thickness of the shale formation). Once the vertical boreholes are drilled, the shale formation penetrated by the vertical boreholes is then subjected to testing, such as nuclear logging, sonic logging, draw-down testing (i.e., permeability testing), and collection of core samples along the shale formation, to name a few. In the illustrative case of FIG. 1, two such vertical boreholes are shown, being boreholes 106 and 108. From the sample data collected form the vertical boreholes 106 and 108 the target zone 102 is identified.

Once the target zone in relation to the vertical boreholes 106 and 108 is identified, it is assumed that the target zone extends linearly (that is, in a straight line sense) between relative locations in the vertical boreholes 106 and 108. From this assumption, one or more "synthetic" surfaces are created in an attempt to identify the target zone. Synthetic surfaces shall be understood to be a mathematical creation—fictional line or surface—and do not necessarily have any true physical components. In the example case of target zone 102 of FIG. 1, a first synthetic surface 110 (shown by dashed line) may identify the assumed upper boundary of the target zone 102, and a second synthetic surface 112 (also shown by dashed line) may identify the assumed lower boundary of the target zone 102.

Based on the one or more synthetic surfaces 110 and 112, a lateral borehole 114 is drilled, with the target path of the lateral borehole to reside in the zone between the one or more synthetic surfaces 110 and 112. Thus, while the drill string used to create the lateral borehole 114 may have measuring-while-drilling ("MWD") tools (e.g., inclination sensor, directional sensor) to facilitate physical placement with respect to the one or more synthetic surfaces 110 and 112 in the shale formations, the lateral borehole 114 is not steered or drilled in such a way as to follow the actual path of the target zone 102. Stated otherwise, the steering in the related-art is geometrically (i.e., in relation to the one or more synthetic surfaces 110 and 112), and no change of direction of a lateral is implemented based on properties of the shale formation. Even in cases where a logging-while-drilling ("LWD") tool is present, the LWD tool will be a gamma package used to correlate with logs from an offset well. Moreover, steering a deviated borehole toward a synthetic surface is an imperfect science, subject to undershoot and overshoot.

FIG. 1 thus illustrates a shortcoming in the way the related-art laterals are placed in shale formations. In particular, the assumption of a linear relationship of the target zone 102 between the vertical boreholes 106 and 108 is, in many cases, not a valid assumption. The lateral 114 may only intermittently contact the target zone 102 both because the target zone resides beyond the synthetic surfaces, and because of inaccuracies in placement of the lateral itself. In the illustrative case of FIG. 1, the lateral initially contacts the target zone 102, at location 116, but loses contact for a distance, and then establishes contact with target zone again, at location 118. However, the displacement along the illustrative fault 104 causes the lateral 114 to again loose contact with the target zone, finally to contact the target zone again, at location 120.

In the related-art, only after the lateral 114 is drilled, and in many cases after the lateral 114 has a casing cemented therein, is the lateral 114 logged and formation evaluation run in such a way as to establish which portions of the lateral 114 contact the target zone 102. One type of log which identifies the target zone along a lateral is the SHALELOG® brand log produced by Landmark Graphics Corporation (a division of Halliburton Energy Services, Inc.), of Houston, Tex. In the related-art, the SHALELOG® brand log is not only produced based on logging data taken after the lateral 114 is drilled (and cased in most situations), but the SHALELOG® brand log is also produced by a person manually correlating the logs taken of the lateral 114 to logs obtained in the vertical boreholes 106 and 108, along with data related to core samples taken in the vertical boreholes 106 and 108.

After the lateral 114 is cased, and the zones of contact between the lateral 114 and the target zone 102 are identified, the lateral is perforated and the portions of the shale formations near the perforations hydraulically fractured. In most cases however, and in spite of the fact that the lateral may only contact the target zone in a limited number of locations, the casing along the entire lateral is perforated, and the entire interval is hydraulically fractured. While a lateral created under the related-art philosophy may produce natural gas, the inventors of the present specification believe that many improvements can be made.

In accordance with the various embodiments, the problems and difficulties of the related-art are addressed, at least in part, by systems and related methods where formation evaluation is performed in real time as the lateral is being drilled. Corrections to drilling direction may then be implemented to increase the contact of the lateral with the target zone. Increased contact of the lateral with the target zone leads to the hydraulic fracturing being applied to larger volumes of the target zone, and thus leading to greater natural gas production. The specification now turns to implementation of such a system, starting with a brief description of shale formations and the mechanical attributes that lead to one or more zones of being identified as target zones.

Shale formations are rock formed by compaction of sediment deposited in layers. The term "shale" actually covers a wide array of compositions of mainly clay minerals and quartz. In the United States, there are several hydrocarbon bearing shale formations, such as the Marcellus shale in the eastern United States, and the Barnett shale in north-central Texas. Regardless of the particular shale formation, target zones for hydrocarbon production are those zones within the shale formation that are more susceptible to fracture during hydraulic fracturing. More particularly still, while shale formations are susceptible to fracturing along their depositional layers (known as the bedding plane), the target zones are those where fracturing is prevalent not only along the bedding plane, but also perpendicular to the bedding plane.

The inventors do not wish to be tied to any particular physical characteristic that leads to an indication of the fracturing potential, as characteristics of the target zones may change for each particular shale formation. However, at least one theory is that thicker depositional layers may contribute to better crack propagation, as the cracks may propagate farther before encountering a discontinuity (e.g., a boundary between layering) that deflects the crack direction. In addition to or in place of the thickness of the depositional layers, clay content of a particular zone of a shale formation may be a factor, where lower clay content leads to better crack propagation.

Speaking more technically, one mechanical property of rock that is an indicator of fracture potential is the brittleness of the rock. In the context of this patent specification, including the claims, "mechanical property" shall refer to how a rock responds to applied forces, for example stress, strain or wave motion. Mechanical property does not refer to a physical property, such as porosity (i.e., the number and size of pore spaces within the rock) or permeability (i.e., how well fluid flows through the pore spaces). Moreover, mechanical property does not refer to electrical properties, such as resistivity to electrical current flow or dielectric strength. If a rock is brittle, the rock tends to crack or fracture under an applied stress or strain. By contrast, a ductile rock tends to plastically deform under stress or strain, and then return to its pre-stress or pre-strain state after the force is removed. In accordance with at least some embodiments, target zones are characterized, at least in part, by brittleness of the zone, with the target zone being more brittle than other portions of the shale formation. Other related mechanical properties, such as Poisson's ratio, Young's modulus and shear modulus, may be equivalently used as indicative of brittleness.

However, in some cases the illustrative mechanical property of brittleness may not, standing alone, be indicative of whether a particular zone is a target zone within the shale formation. As mentioned above, a particular zone may be brittle, but for a variety of reasons the brittleness may be anisotropic. That is, the brittleness may be oriented predominantly in a particular direction, such as along the sedimentary bedding plane. Thus, in accordance with at least some embodiments, in addition to the presence of hydrocarbons, a particular zone may be identified as a target zone if the contrast between brittleness along the bedding plane, and the brittleness perpendicular to the bedding plane, is low. Stated another way, if a particular mechanical property along the bedding plane approaches or is substantially the same as the mechanical property perpendicular to the bedding plane, then the particular zone may be a target zone in accordance with the various embodiments.

Other mechanical properties may likewise be indicative of fracture potential. For example, two different modes of wave propagation may occur in solids such as rocks—compressional waves (known as "P") and shear waves. In some cases, the amount of energy loss as a function of distance traveled of a compressional wave may be indicative of fracture potential. More specifically, the compressional wave impedance of a rock formation may be indicative of fracture potential. Likewise, shear wave impedance may be indicative of fracture potential. In the case of shear waves, the shear waves may be "broken" into a fast and slow component. That is, shears waves may travel at the different speed, or experience different amplitude loss per unit distance traveled, depending on the orientation of the shear. In such cases, ratio of the slow and fast shear waves (known as the transverse isotropic, vertical axis symmetry ("TIV") ratio) may be indicative fracture potential. The specification now turns to an illustrative drilling system for drilling laterals into the target zones.

Figure 2:
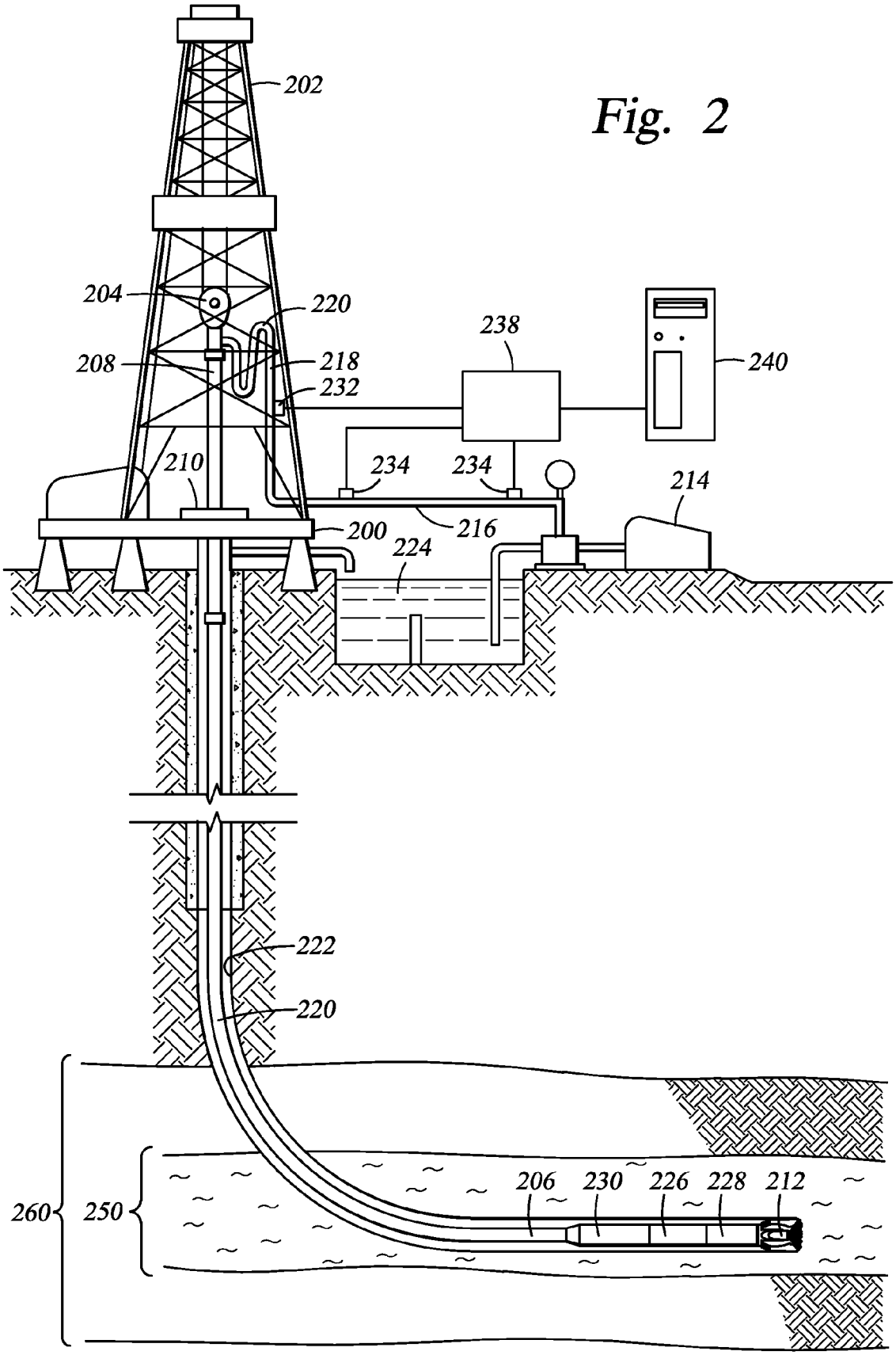
FIG. 2 shows a drilling system in accordance with at least some embodiments.

FIG. 2 shows a drilling operation in accordance with at least some embodiments. In particular, FIG. 2 shows a drilling platform 200 equipped with a derrick 202 that supports a hoist 204. Drilling of the laterals in accordance with some embodiments is carried out by a string of drill pipes connected together by "tool" joints so as to form a drill string 206. The hoist 204 suspends a top drive 208 that is used to rotate the drill string 206 and to lower the drill string through the wellhead 210. Connected to the lower end of the drill string 206 is a drill bit 212. The drill bit 212 is rotated and drilling accomplished by rotating the drill string 206, by use of a downhole "mud" motor near the drill bit 212 that turns the drill bit, or by both methods. In some cases, the system utilized is a rotary steerable system, where "direction" is controlled by rotating the drill string at the surface and drilling action is provided by the downhole motor near the drill bit. Drilling fluid is pumped by mud pump 214 through flow line 216, stand pipe 218, goose neck 220, top drive 208, and down through the drill string 206 at high pressures and volumes to emerge through nozzles or jets in the drill bit 212. The drilling fluid then travels back up the borehole via the annulus 220 formed between the exterior of the drill string 206 and the borehole wall 222, through a blowout preventer (not specifically shown), and into a mud pit 224 on the surface. On the surface, the drilling fluid is cleaned and then circulated again by mud pump 214. The drilling fluid is used to cool the drill bit 212, to carry cuttings from the base of the borehole to the surface, and to balance the hydrostatic pressure in the rock formations.

In accordance with the various embodiments, the drill string 206 employs at least one LWD tool 226, and in some cases a MWD tool 228. The distinction between LWD and MWD is sometimes blurred in the industry, but for purposes of this specification and claims, LWD tools measure properties of the surrounding formation (e.g., porosity, permeability, speed of sound, electrical resistivity), and MWD tools measure properties associated with the borehole (e.g., inclination, direction, downhole drilling fluid pressure, downhole temperature). The downhole tools 226 and 228 may be coupled to a telemetry module 230 that transmits the data to the surface. In some embodiments, the telemetry module 230 sends data to the surface electromagnetically. In other cases, the telemetry module 230 sends data to the surface by way of electrical or optical conductors embedded in the pipes that make up the drill string 206. In yet still other cases, the telemetry module 230 modulates a resistance to drilling fluid flow within the drill string to generate pressure pulses that propagate at the speed of sound of the drilling fluid to the surface.

Still referring to FIG. 2, in the illustrative case of data encoded in pressure pulses that propagate to the surface, one or more transducers, such as transducers 232, 234 and/or 236, convert the pressure signal into electrical signals for a signal digitizer 238 (e.g., an analog to digital converter). While three transducers 232, 234 and/or 236 are illustrated, a greater number of transducers, or fewer transducers, may be equivalently used. The digitizer 238 supplies a digital form of the pressure signals to a computer 240 or some other form of a data processing device. Computer 240 operates in accordance with software (which may be stored on a computer-readable storage medium) to process and decode the received signals. The resulting telemetry data may be further analyzed and processed by computer 240 to directly make, or to assist a driller in making, changes and/or corrections to the drilling direction to help ensure that the lower end of the drill string 206 remains within the target zone 250 of the shale formation 260.

The combinations of LWD tools 226 that could be included in the drill string 206 to accomplishing steering into the target zone 102 based on fracture potential of the encountered zones are numerous. Thus the specification provides a representative sample of such tools, and how data gathered from such tools may be used to estimate or determine a mechanical property of the shale formation.

As mentioned above, the mechanical property of brittleness of a portion of a shale formation, either alone, or considered in the direction of the bedding plane and perpendicular to the bedding plane, may be indicative of the fracturing potential of the portion of the shale formation. Brittleness, however, is a mechanical property related to responsiveness to applied stresses, and cannot be directly measured in real time during drilling. However, there are measurements that can be made that are indicative of the brittleness, for example speed of sound measurements. In particular, in accordance with at least some embodiments, the LWD tool 226 is an acoustic tool capable of making sonic-based speed of sound measurements of the formation near the drill bit while drilling. More particularly, in accordance with at least some embodiments, the LWD tool 226 is an acoustic tool capable of taking sonic-based measurements that differentiate between a fast polarization and a slow polarization of the speed of sound (of shear or compression waves) within the shale formation near the drill bit. For example, tools such as the bi-modal acoustic tool (BAT™) available from Halliburton Energy Services, or the QBAT™ multipole tool also available from Halliburton Energy Services, may be used to take measurements that are sensitive to the fast and slow polarizations of the sonic waveforms.

Thus, in accordance with at least some embodiments, the LWD tool 226 makes sonic-based speed of sound measurements of the formation near the drill bit while drilling, and more particularly measurements that differentiate between fast and slow polarization of the speed of sound (of shear or compression waves). From the fast and slow measured values, an estimate of fracture potential (based on a mechanical property) of the portion of the formation near the drill bit is made, and drilling direction is controlled based on the estimate of the fracture potential (e.g., either to more fully enter a target zone, or to make corrections to re-enter the target zone). In a particular case, the ratio of the speed of the slow and fast shear waves may be used (the TIV Ratio). In some cases, the measured speed of sound of the fast and slow polarizations being substantially the same is an indication that the brittleness along the bedding plane, and perpendicular to the bedding plane, are approaching the same value. In cases where brittleness along the bedding plane, and perpendicular to the bedding plane, are approaching the same value, the formation may be more susceptible to fracturing that leads to hydrocarbon production in economically viable quantities. By contrast, where portions of the formation near the drill bit have high contrast between the fast and slow polarizations, such may be indicative of a portion of the formation where, if hydraulically fractured, may lead to good fracturing along the bedding plane but relatively little fracturing perpendicular to the bedding plane. In the situation of relatively little fracturing perpendicular to the bedding plane, it is unlikely that the expense of hydraulically fracturing will lead to hydrocarbon production in commercially viable quantities.

The various embodiments that determine or estimate the mechanical property of the shale formation using a sonic-based speed of sound measurement need not rely on the sonic-based measurement alone for placement of the lateral in the target zone. For example, in some embodiments the initial direction and assumed target zone may be estimated in advance based on data obtained from the vertical boreholes, and/or or from other lateral boreholes drilling into the target zones at other locations (which may be known as offset wells) away from but relatively close to the current lateral being drilled. Stated otherwise, initially steering of the lateral may be toward one or more synthetic surfaces, but as the distal end of the drill string approaches the target zone, the drilling direction changes and corrections will be based on the sonic-based measurements.

In accordance with other embodiments, the LWD tool 226 makes sonic-based stress anisotropy measurements (i.e., orientation of the stresses) of the formation near the drill bit while drilling. It is noted that sonic-based stress anisotropy measurements are related to sonic-based speed of sound measurements; however, speed of sound in some cases need not be calculated to determine stress anisotropy. For example, sonic wave attenuation (impedance) along a particular propagation direction may be indicative of stress along that particular direction, without necessarily needing to determine speed of sound in along that particular direction. The sonic wave attenuation values could be of either compressional waves, shear waves, or both. Further still, the phase shift of sonic waves along a particular propagation direction may be indicative of stress along that particular direction, again without necessarily needing to determine speed of sound in along that particular direction. An estimate of a mechanical property of the portion of the formation near the drill bit may be made based on the stress determination, and drilling direction controlled based on the estimate of the fracture potential as indicated by the stress determination (i.e., either to more fully enter a target zone, or to make corrections to re-enter a target zone). In some cases, the stress anisotropy approaching or becoming substantially zero is an indication that the brittleness along the bedding plane, and perpendicular to the bedding plane, is approaching the same value. Stated otherwise, where stress is about the same along the bedding plane and perpendicular to the bedding plane, such is an indication that the mechanical property of brittleness is likewise about the same along the bedding plane and perpendicular to the bedding plane. By contrast, where portions of the formation near the drill bit have high contrast as between directional stress, such may be indicative of a portion of the formation where, if hydraulically fractured, may lead to good fracturing along the prevailing stress direction (most likely, along the bedding plane), but relatively little fracturing perpendicular to the bedding plane.

The various embodiments based on the LWD tool 226 measuring wave impedance and/or stress anisotropy need not rely on the sonic-based measurement alone for placement of the lateral in the target zone. Here again, in some embodiments the initial direction and assumed target zone may be estimated in advance based on data obtained from the vertical boreholes, and/or or from other lateral boreholes drilling into the target zones at other locations (which may be known as offset wells) away from but relatively close to the current lateral being drilled. Stated otherwise, initially steering of the lateral may be toward one or more synthetic surfaces, but as the distal end of the drill string approaches the target zone, the drilling direction changes and corrections will be based on the measured stress anisotropy as indicative of brittleness.

The various embodiments of determining or estimating fracture potential of the portion of the shale formation near the drill bit in real time discussed to this point have assumed a single LWD tool 226 measuring a mechanical property, and then changing or correcting steering direction based on the mechanical property in real time with drilling. However, the various embodiments are not limited to a single LWD tool 226, and many LWD tools 226 may be present to assist in initial placement of the lateral and/or verifying assumptions for placement of the lateral. For example, in many drilling situations a suite of LWD tools is included in the drill string 206, such as the combination known in the industry as "triple-combination" or "triple-combo" suite of LWD tools. Though there may be slight variance, in most cases the triple-combo suite of logging tools comprises a neutron porosity tool, a density porosity tool, and a resistivity tool.

The neutron porosity tool is a neutron-gamma tool, indicating that the formation is interrogated with neutrons, and measurements are made based on gamma radiation or gamma particles (hereafter, just gammas) that arrive back at the tool responsive to neutron interactions with atoms in the formation. Neutron porosity tools measure hydrogen index, and porosity may be inferred from the hydrogen index determination. The density porosity tool is a gamma-gamma tool, indicating that the formation is interrogated with gammas, and measurements are based on gammas received back at the tool responsive to gamma interactions with atoms in the formation. Density porosity tools measure bulk density, and likewise porosity may be inferred from the bulk density measurement (e.g., low bulk density indicates high porosity and/or high total organic content). The resistivity tool measures electrical resistivity of the surrounding formation. In situations where conductive drilling fluid is used, the resistivity measurements may be by way of a conduction tool, where electrical current flows on and off the tool into the formation. In situations where non-conductive drilling fluid is used, the resistivity measurements may be way of an inductive tool, which launches electromagnetic waves from the tool into the formation.

Before proceeding, an important distinction between the related-art and the various embodiments is discussed. In particular, outside of shale formations the triple-combo logging tools have been and are used to help guide or steer drilling in the related-art. As discussed above, drill strings for laterals for shale formations have traditionally not included the triple-combo LWD tools. However, even in situations where the triple-combo logging tools are included in a drill string, it does not appear that data gathered by the illustrative triple-combo logging tools is used for formation evaluation to estimate and/or determine a mechanical property of a formation in real time with the drilling. That is, while the triple-combo LWD tools may read data while drilling (i.e., take measurements in real time), it does not appear that the data gathered by such tools is used to estimate and/or determine a mechanical property of a formation in real time.

Rather, in the related-art the triple-combo LWD tools appear to be used in what is known as "geosteering." In geosteering, the borehole is drilled and the drill string steered based on correlating data obtained by the LWD tools to previously obtained data, such as data obtained from survey boreholes and/or offset wells. Stated otherwise, the triple-combo LWD tools provide information to correlate the location of the borehole to information from survey and/or offset boreholes, and corrections can be made to drilling direction. For example, the triple-combo LWD tools may used to correlate position markers (e.g., transition of the borehole between easily identifiable rock-type transitions). But such is not controlling drilling direction based on a mechanical property estimated and/or determined in real time.

Moreover, triple-combo LWD tool data appears to show little, if any, distinction between portions of a shale formation. For example, a neutron porosity tool, which tool measures hydrogen index and from which porosity may be inferred, may show little to no distinction between a target zone within a shale formation and a non-target zone. Likewise, a density porosity tool may show low bulk density both in the target zone of the shale formation and outside the target zone. The same may be true for resistivity, as resistivity in the shale formation (target or non-target zone) may be substantially uniform. The relative "blindness" of the triple-combo LWD tools to the distinction between target and non-target zones in shale formations may be one reason why few, if any, laterals drilled into shale formations include the triple-combo LWD tools.

However, in accordance with the various embodiments a triple-combo set of logging tools may be used to estimate and/or determine the mechanical property in real time. In particular, in the illustrative triple-combo embodiments, the data read by the triple-combo logging tools may be compared to or analyzed against previously created SHALELOG® brand logs for one more previously drilled boreholes, as well the data used to create the SHALELOG® brand logs. For example, the SHALELOG® brand log data may be created with respect to the vertical boreholes, or one or more offset lateral boreholes, and the triple-combo data obtained while drilling the lateral may be analyzed against such SHALELOG® brand logs and the data used to create the SHALELOG® brand logs. Based on the comparisons and analysis, the mechanical property of the shale formation near the drill bit (e.g., within 100 feet of the drill bit) may be estimated or determined in real time by determining the current location of the drill bit in relation to the calculated mechanical properties used to produce the SHALELOG® brand logs.

It is noted, however, that LWD tools from which kerogen content may be determined (i.e., neutron-gamma tools) may be used in conjunction and/or to verify the fracture potential. That is, while other measured mechanical properties may be indicative of fracture potential, in cases where the fracture potential favorable, kerogen corrected density porosity may provide a confirming indication. That is, zone with favorable fracture potential, but without a confirming kerogen corrected density porosity, may be easily fractured but have less than economically viable hydrogen content.

In addition to the triple-combo LWD tools, the industry also sometimes implements a "quad-combination" or "quad-combo" set of logging tools, that comprises all the tools of the triple-combo, and also a sonic-based tool. However, it is noted that data obtained by a sonic-based tool in the quad-combo LWD tools appears to be gathered while-drilling, but then used later to help make completion verifications and/or determinations. Stated otherwise, it does not appear that even in systems where the quad-combo LWD tools are provided that the geosteering implemented makes directional changes within a single formation type (e.g., shale) based on a mechanical property estimated and/or determined using the data obtained sonic-based tool.

Figure 3:
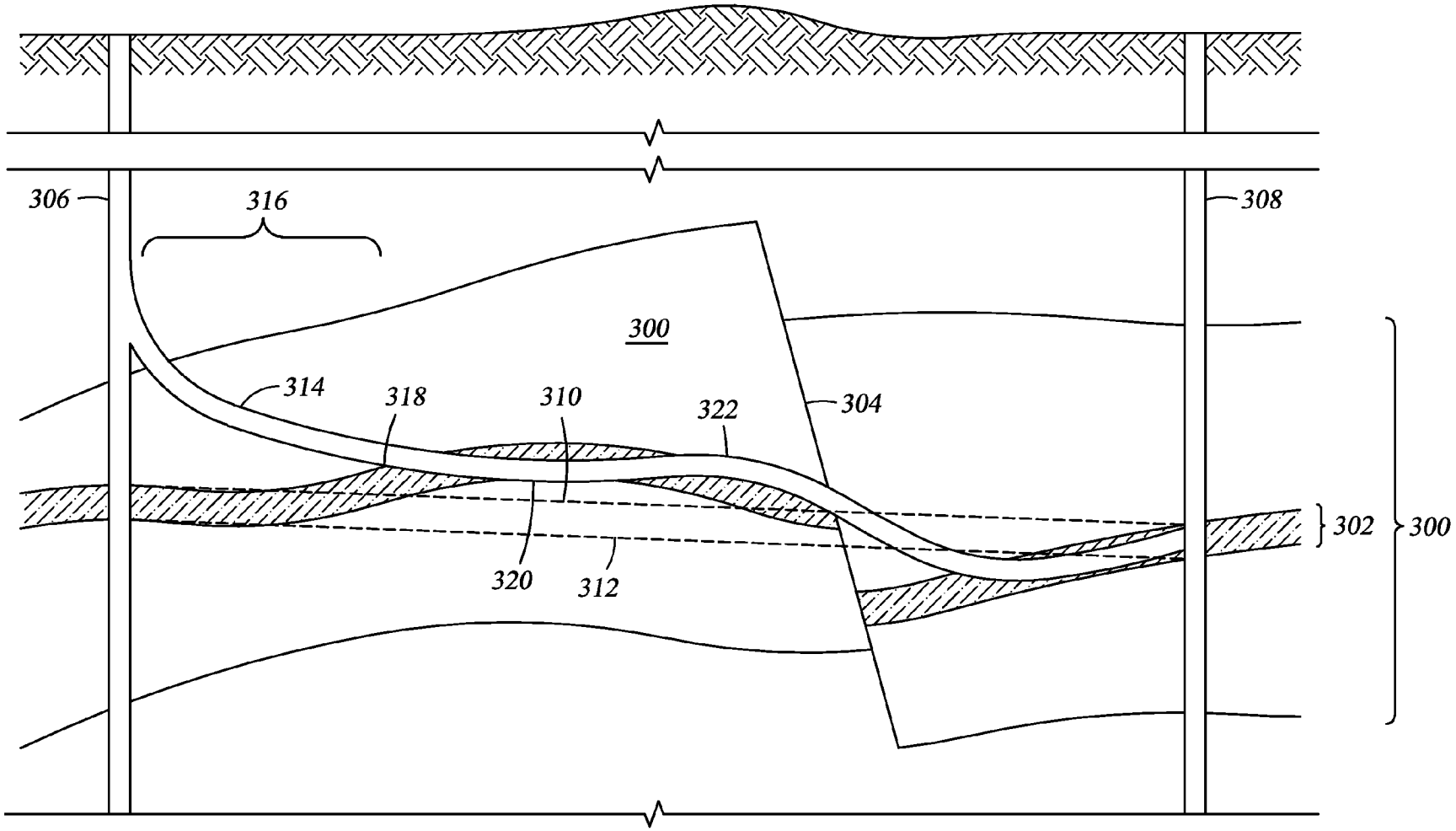
FIG. 3 shows a cross-sectional view of a shale formation to explain lateral placement in accordance with the various embodiments.

FIG. 3 shows a cross-sectional view of a shale formation 300, having a single target zone 302, in order to describe the drilling of lateral wells in accordance with the various embodiments. Much like the shale formation 100 of FIG. 1, the illustrative shale formation 300 has a fault 304 which resulted in a vertical shift of otherwise related portions of the shale formation 300.

Prior to drilling the lateral 314, the target zones are identified, such as by drilling one or more vertical boreholes 306 and 308 through the shale formation. Once the vertical boreholes are drilled, the shale formation 300 is then subjected to testing, such as nuclear logging, sonic logging, draw-down testing, and collection of core samples along the shale formation, to name a few. In the illustrative case of FIG. 3, two vertical boreholes are shown, but in embodiments utilizing vertical boreholes, one or more vertical boreholes may be used. From the data gathered, the target zone 302 is identified. In other embodiments, the target zones may be identified and/or verified by other means, such as "3D" seismic operations performed from the surface.

Once the target zone is identified, one or more "synthetic" surfaces are created which identify a particular target zone. In the example case of target zone 302 of FIG. 3, a first synthetic surface 310 (shown by dashed line) may identify the assumed upper boundary of the target zone 302, and a second synthetic surface 312 (also shown by dashed line) may identify the assumed lower boundary of the target zone 302.

Based on the one or more synthetic surfaces 310 and 312, a lateral borehole 314 is drilled, with the target path of the lateral borehole initially being to reside between the one or more synthetic surfaces 310 and 312. Stated otherwise, in at least some embodiments portions of the lateral 314 are drilled to a target identified by the one or more synthetic surfaces 310 and/or 312, such as portion 316 of lateral 314. While FIG. 3 illustrates the lateral 314 to be drilled starting from within the vertical borehole 306, in other cases the lateral may be a separately drilled borehole, having its own vertical portion through the overburden, and then having a deviated portion which becomes the lateral 314.

The drill string used to create the lateral borehole 314 may have MWD tools (e.g., inclination sensor, directional sensor) to facilitate initial drilling direction toward the one or more synthetic surfaces 310 and 312. However, as the lateral 314 enters the shale formation 300, and particularly as the lateral approaches the target zone 302, steering of the lateral is based on a mechanical property estimated and/or determined from LWD tools 226 (FIG. 2) in the drill string that creates the lateral 314.

Still referring to FIG. 3, consider the situation as the lateral 314 being drilled approaches the target zone 302 at location 318. In accordance with various embodiments, at least while portions of the drill string are within the shale formation 300, the drilling system continuously estimates and/or determines fracture potential of the shale formation 300 near the drill bit in real time as the drill string penetrates the shale formation 300, which fracture potential may in some cases be indicated by a mechanical property of the shale. As the drill bit penetrates the target zone 302, the mechanical property will indicate a change in fracture potential indicative of entering the target zone 302, in spite of the fact the drill string has yet to penetrate the zone between the illustrative synthetic surfaces 310 and 312. For example, a value indicative of brittleness determined from the LWD data may indicate crossing into a zone of higher fracture potential, and/or crossing into a zone where the brittleness along the bedding plane, and perpendicular to the bedding plane, is substantially the same (again indicating a zone of higher fracture potential).

In accordance with the various embodiments, based on the indication of entering the target zone 302, the drilling direction is controlled and/or changed to account for encountering the target zone 302 earlier than expected, and to attempt to remain within the target zone 302. Thus, rather than continue to steer for the zone between the synthetic surfaces 310 and 312, the lateral 314 is turned to stay within the target zone 302. In an ideal situation, once the target zone 312 is penetrated by lateral, the lateral 314 remains within the target zone 302 over the entire planned length of the lateral, which may be several thousand feet. However, the undulating nature of the target zone 302 caused by differential compaction, as well as localized faults, such as fault 304, may make keeping the lateral 314 in the target zone 302 difficult.

FIG. 3 further illustrates that the various embodiments may be used not only to initially steer the lateral 314 into the target zone 302, but also to ensure that the lateral remains, to the extent possible based on turning radius of the drill string, within the target zone 302 as the target zone 302 changes in vertical depth. For example, at location 320 the illustrative lateral 314 partially exits the target zone 314, the partial exit caused by the change in vertical depth of the target zone 302 at that location. In accordance with the various embodiments, an unwanted exit of the lateral 314 from the target zone 302 may be detected by a change in the mechanical property estimated and/or determined by the system. In some cases, the LWD tool 226 in the drill string has the ability to sense contrast of the measured properties both above and below the lateral 314, and thus may be able to sense an approaching bed boundary between the target zone 302 and the portions of the shale formation below the target zone 302 (yet all still within the same shale formation). In other cases, the exiting of the lateral 314 may not be fully sensed until the lateral 314 fully exits the target zone 302. Regardless, in accordance with the various embodiments the drilling direction is changed when the mechanical property indicates an approaching boundary, or crossing a boundary, such that the lateral 314 remains within the target zone.

Similar issues with respect to the lateral 314 and the target zone 302 are shown in FIG. 3 at location 322 (where the illustrative lateral exits the top of the target zone 302), and corrections are made to bring the lateral back within the target zone. Likewise, FIG. 3 shows the lateral 314 exiting the target zone 302 at the fault 304. In the illustrative situation of the fault 304, either the driller and/or the system make a guess as to which direction (up or down) to steer the lateral to again intercept the target zone. On the other hand, if the fault 304 was known in advance, then the direction to drill to once again intercept the target zone 302 may be known. In any event, with a system of the various embodiments estimating and/or determining a mechanical property, knowledge of when the lateral 314 again intercepts the target zone 302 will be known.

Comparing the lateral 314 of FIG. 3 to the lateral 114 of FIG. 1, it is seen that the lateral 314 resides within the target zone 302 for a significantly greater portion of the length than the lateral 114. Because of the significantly greater correspondence between the lateral 314 and the target zone 302, hydraulic fracturing will have a greater effect, and since the general rule is that, in shale formations, one only produces hydrocarbons from areas that have been hydraulically fractured, the lateral 314 of FIG. 3 should produce significantly greater hydrocarbons that the lateral 114 of FIG. 1.

Figure 4:
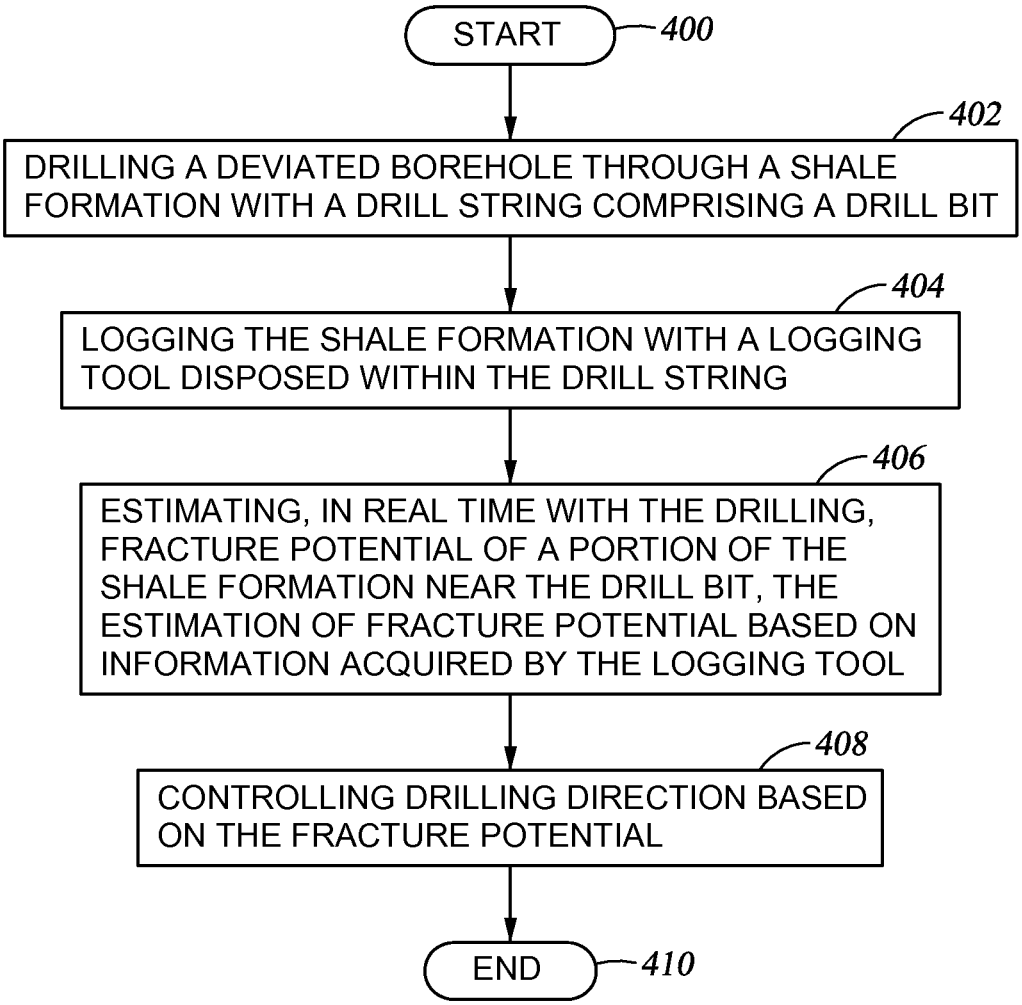
FIG. 4 shows a method in accordance with at least some embodiments.

FIG. 4 shows a method (some of which may be implemented in software) in accordance with at least some embodiments. In particular, the method starts (block 400) and proceeds to drilling a deviated borehole through a shale formation with a drill string comprising a drill bit (block 402). As discussed, the drilling could be by any suitable form, such as by way of a drilling rig using discrete pipe sections to make up the drill string, or by way of a coiled-tubing system wherein the drill string is comprised of tubing, and using a downhole "tractor" to move the drill string and to apply force to the drill bit. Regardless of the precise method of drilling, the illustrative method further comprises logging the shale formation with a logging tool disposed within the drill string (block 404). The logging tool likewise may take many forms. In some embodiments a single LWD tool, such a sonic-based tool capable of measuring differences in a sonic-based parameter along different directions (e.g., fast and slow polarization of the speed of sound, stress anisotropy). In other cases, the at least one logging tool may comprise the triple-combo or quad-combo suite of logging tools.

Based on the data obtained by the one or more logging tools, the illustrative method may then proceed to estimating, in real time with the drilling, fracture potential of a portion of the shale formation near the drill bit, the estimation of the fracture potential based on information acquired by the logging tool (block 406). For example, an estimate of brittleness of the formation may be made both along the bedding plane, and perpendicular to the bedding plane. In the case of a triple-combo (with no sonic-based tool), the estimate of the mechanical property may be by analysis of the data obtained by the tripe-combo logging tools against SHALELOG® brand logs previously constructed, and determining a relative location of the drill bit in relation to the SHALELOG® based data. Finally, the illustrative method may comprise controlling drilling direction based on the fracture potential (block 408), and the method ends (block 410).

Figure 5:
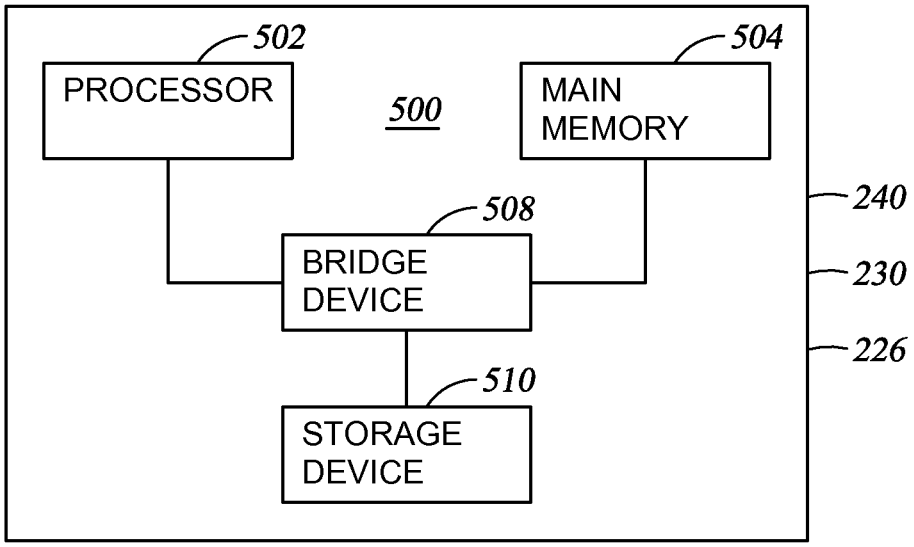
FIG. 5 shows a computer system in accordance with at least some embodiments.

FIG. 5 illustrates in greater detail a computer system 500 which may be used to determine or estimate the mechanical property of the portion of the shale formation near the drill bit.

The computer system 500 thus may be illustrative of the surface computer system 240, the telemetry module 230, and/or the one or more LWD tools 226. Thus, the computer system 500 described with respect to FIG. 5 could be at the surface near (but physically outside) the borehole during the time period the lateral is being drilled, the computer system 500 could be located at the central office of the oilfield services company, the computer system 500 could be within the telemetry module 230 (and thus in the borehole), or the computer system 500 could be within the one or more logging tools 226 (and thus in the borehole). The computer system 500 comprises a processor 502, and the processor couples to a main memory 504 by way of a bridge device 508. Moreover, the processor 502 may couple to a long term storage device 510 (e.g., a hard drive) by way of the bridge device 508. Programs executable by the processor 502 may be stored on the storage device 510, and accessed when needed by the processor 502. The program stored on the storage device 510 may comprise programs to implement the various embodiments of the present specification, including programs to measure or receive data from one or more logging tools, and to estimate or determine a mechanic property of the formation near the drill bit in real time with the drilling of the shale formation. In some cases, the programs are copied from the storage device 510 to the main memory 504, and the programs are executed from the main memory 504. Thus, both the main memory 504 and storage device 510 are considered computer-readable storage mediums.

Figure 6:
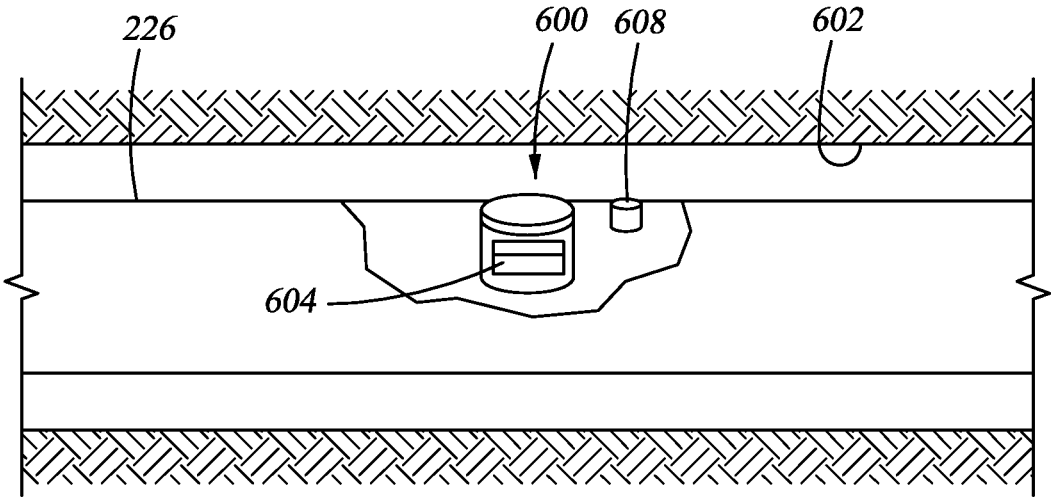
FIG. 6 shows a logging tool in accordance with at least some embodiments.

The various embodiments discussed to this point have assumed that the estimate and/or determination of the mechanical property used to establish whether the drill string is within the target zone were based on interrogating the shale formation at some depth beyond the borehole; however, in yet still other embodiments the estimate of the mechanical property may be made visually or optically. FIG. 6 shows a logging tool in accordance with other embodiments. In particular, FIG. 6 shows logging tool 226 may further comprise a camera device 600 positioned to view the borehole wall 602 during drilling. The camera device 600 may comprise, for example a charge-coupled-device ("CCD") array 604 in combination with a lens 606 and one more illumination sources 608. Thus the logging tool 226 in the form of optical system may take still pictures, or a series of still pictures (which may thus become motion video), of the borehole wall, and from the pictures make an estimate of the mechanical property of the shale formation. For example, if the picture or video of the borehole wall 602 shows thin layering of the shale formation, such may be indicative of differences in brittleness along the bedding plane as compared to perpendicular to the bedding plane. Likewise, a lack of thin layering may indicate that the brittleness along the bedding plane and perpendicular to the bedding plane are substantially the same. As yet a further example, the color of a portion of a shale formation may provide information as to the susceptibility of the portion of the shale formation.

While the logging tool 226 in the form of an optical device may be used in the visible spectrum, the various embodiments are not limited to the visual spectrum. For example, the illumination source 608 may provide "illumination" at wavelengths above or below visible, and the CCD array 604 may likewise be designed and constructed to be sensitive such wavelengths. The visual picture or motion video create may thus be from wavelengths above or below visible, appropriately adjusted to the visible spectrum for interpretation. Further still, the interpretation to estimate the mechanical parameter may be determined by image processing software, operating on still images or video taken by the logging tool 226.

The still pictures and/or motion video may be processed downhole, and values sent to the surface where the values indicate the estimated mechanical parameter. In yet still other cases, particularly cases that utilize electrically or optically wired tubing, the still pictures and or motion video may be sent to the surface for observation and/or analysis.

From the description provided herein, those skilled in the art are readily able to combine software created as described with appropriate general-purpose or special-purpose computer hardware to create a computer system and/or computer sub-components in accordance with the various embodiments, to create a computer system and/or computer sub-components for carrying out the methods of the various embodiments and/or to create a computer-readable media that stores a software program to implement the method aspects of the various embodiments.

The above discussion is meant to be illustrative of the principles and various embodiments of the present invention. Numerous variations and modifications will become apparent to those skilled in the art once the above disclosure is fully appreciated. For example, while the various embodiments have been shown in connection with a drill string created from individual pipe sections, the various embodiments equally applicable to drilling situations where coiled tubing is used, in connection with a downhole "tractor" which provides drilling force on the drill bit. Further, while reference herein is made to "acoustic" and "sonic" logging tools, it is noted that such do not necessarily refer to audible sound. Such acoustic/sonic tools may operate below audible, in the audible range, or above audible, yet still fall within the various embodiments. It is intended that the following claims be interpreted to embrace all such variations and modifications.

What is claimed is:

1. A method comprising:

drilling a deviated borehole through a shale formation with a drill string comprising a drill bit; and simultaneously logging the shale formation with a logging tool disposed within the drill string;

estimating, in real time with the drilling, fracture potential of a portion of the shale formation near the drill bit, the estimation of the fracture potential based on information acquired by the logging tool; and controlling drilling direction based on the fracture potential.

2. The method of claim 1 wherein estimating the fracture potential further comprises estimating brittleness of the portion of the shale formation.

3. The method of claim 1 wherein estimating the fracture potential further comprises calculating a ratio of speed of sound of fast and slow shear waves.

4. The method of claim 1 wherein estimating the fracture potential further comprises estimating based on at least one selected from the group consisting of: compressional wave impedance; and shear wave impedance.

5. The method of claim 1 wherein estimating further comprises estimating contrast in brittleness along a direction of a bedding plane of the shale formation and perpendicular to the bedding plane of the portion of the shale formation.

6. The method of claim 1 wherein estimating further comprises estimating based on measurements of the logging tool taking sonic-based measurements of the portion of the shale formation.

7. The method of claim 1 wherein estimating further comprises estimating based on measurements of the logging tool taking sonic-based measurements that differentiate between a fast and slow polarization of shear waves within the shale formation.

8. The method of claim 7 wherein controlling further comprises steering the drill string to stay within portions of the shale formation where the fast and slow polarizations of the shear waves are substantially the same.

9. The method of claim 1 wherein estimating further comprises estimating based on measurements of the logging tool taking sonic-based speed of sound measurements that differentiate between a fast and slow polarization of the speed of sound.

10. The method of claim 9 wherein controlling further comprises steering the drill string to stay within portions of the shale formation where the fast and slow polarizations of the speed of sound measurements are substantially the same.

11. The method of claim 1 wherein estimating further comprises estimating based on measurements of the logging tool making sonic-based measurements of stress anisotropy.

12. The method of claim 11 wherein controlling further comprises steering the drill string to stay within portions of the shale formation where the stress anisotropy is substantially zero.

13. The method of claim 1 wherein drilling the deviated borehole further comprises initially drilling toward a predetermined zone, the predetermined zone determined based on seismic measurements prior to drilling.

14. The method of claim 1 wherein drilling the deviated borehole further comprises initially drilling toward a predetermined zone, the predetermined zone determined based on data gathered from boreholes previously drilled into the shale formation.

15. The method of claim 1 wherein estimating further comprises estimating based on optical observation of the portion of the shale formation by the logging tool.

16. A system comprising:

a logging tool disposed within a drill string, the drill string comprising a drill bit and the drill string located in a deviated borehole disposed within a shale formation;

a processor associated with the logging tool;

a memory coupled to the processor, the memory storing a program that, when executed by the processor, causes the processor to:

receive data determined by the logging tool while drilling, the data indicative of a parameter of the shale formation;

estimate, in real time with the drilling by the drill string, a mechanical property of a portion of the formation near the drill bit, the estimation of the mechanical property based on data determined by the logging tool.

17. The system of claim 16 wherein the logging tool is an acoustic-based tool.

18. The system of claim 16 wherein the processor and memory are disposed within the deviated borehole.

19. The system of claim 16 wherein the processor and memory are disposed at the surface, and the data indicative of the shale formation is sent to the surface.

20. The system of claim 16 wherein the drill string is at least one selected from the group consisting of: a drill string where rotary motion is imparted to the drill string from the surface; a drill string where rotary motion is imparted to the drill string by way of a down-hole mud motor; and a rotary steerable system.

* * * * *